US006681404B1

(12) United States Patent
Adlard et al.

(10) Patent No.: US 6,681,404 B1
(45) Date of Patent: Jan. 27, 2004

(54) GARMENT WITH POUCH FOR MEDICAL MONITOR

(76) Inventors: Terry K. Adlard, 164 Borad St. South, Monmouth, OR (US) 97361; Patricia A. Edwards, 640 "J" St., Springfield, OR (US) 97477

( * ) Notice: Subject to any disclaimer, the term of this patent is extended or adjusted under 35 U.S.C. 154(b) by 0 days.

(21) Appl. No.: 10/396,922

(22) Filed: Mar. 25, 2003

(51) Int. Cl.[7] ..... A41D 1/00
(52) U.S. Cl. ..... 2/94; 604/174
(58) Field of Search ..... 2/114, 115, 113, 2/69, 104–106, 93, 94, 85, 247–253; 128/875, 876, 877, 874; 600/388–390; 604/174, 179, 345

(56) References Cited

U.S. PATENT DOCUMENTS 4,578,062 A * 3/1986 Schneider ..... 604/174
4,582,508 A * 4/1986 Pavelka ..... 604/179
4,666,432 A * 5/1987 McNeish et al. ..... 604/174
4,698,848 A 10/1987 Buckley
5,611,085 A 3/1997 Rasmussen
5,708,978 A 1/1998 Johnsrud
5,755,698 A * 5/1998 Kagan et al. ..... 604/179
5,991,923 A * 11/1999 Maria ..... 2/83
6,032,289 A * 3/2000 Villapiano ..... 2/102
6,055,668 A 5/2000 Gros et al.
6,336,458 B1 * 1/2002 Nafziger ..... 128/846
6,460,187 B1 * 10/2002 Siegel ..... 2/114
6,477,710 B1 * 11/2002 Ojoyeyi ..... 2/69

* cited by examiner

*Primary Examiner*—Tejash Patel
(74) *Attorney, Agent, or Firm*—Sturm & Fix LLP

(57) ABSTRACT

Patients are sometimes required to carry various medical appliances such as cardiac, gastric, or sleep apnea monitors, or medication injectors (either infusion pumps or other intravenous injectors). To carry these devices comfortably, a garment is worn having a pouch and shoulder straps. The pouch can be worn on the chest or back of the patient. The shoulder straps extend over the shoulders and are affixed to secure the garment to the wearer. In one embodiment, the ends of the straps are attached to a region near the bottom of the pouch. In a second embodiment, a back strap is passed around the patient's lower torso and the ends affixed to a region near the bottom of the pouch, and the shoulder straps affixed to the back strap.

12 Claims, 2 Drawing Sheets

GARMENT WITH POUCH FOR MEDICAL MONITOR

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates generally to a garment for use when a medical monitor must be carried or worn by a human patient. More particularly the present invention relates to a halter-type garment with shoulder straps and a pouch that can be worn in the front or rear of the patient for storing a medical appliance; and having a grommet opening through which leads are passed to the patient's body.

2. Description of Related Art

There is occasional need for a patient to carry with him/her a portable medical monitor or other medical appliance. Because such a device is extraneous to the body, there is a possibility of inconvenience, discomfort, and/or irritation associated with the carrying of such a device.

Devices that may need carried with a patient include heart, gastric, or sleep apnea monitors, and medication injectors (either an infusion pump or another intravenous injector). Such devices are made as small and light as possible, and enjoy continuous improvement with regard to these aspects, yet still represent an object the body is not made to carry with it.

A medical vest for carrying a medical monitor is disclosed by Johnsrud in U.S. Pat. No. 5,708,978. The vest extends to the lower chest region and is split in the front for ease of putting on and taking off. The straps are permanently affixed to the vest at the front and back, making removal of the halter difficult in the case of a patient having limited mobility in his/her arms and shoulders—or of the patient is incapacitated. The pocket or pouch in which the medical monitor is inserted hangs from the lower edge of the vest. The pocket is sewn to the vest along the pocket's upper edge, and hangs down from the vest's lower edge in a loose manner for free sliding movement relative to the body of the wearer.

A garment, similar to the above, is disclosed in U.S. Pat. No. 6,055,668 by Gros, et al. This garment is also split in the front for putting on and taking off. The straps are attached to the front of the garment by hook and loop material for extra ease in removing or putting on the garment. The straps do not cross. Along the lower edge of the garment is a hem of exposed hook and loop material upon which various pockets or bags may be attached. Attaching a medical appliance to the garment via hook and loop material would prove troublesome due to the continuous possibility of the pouch falling off and the discomfort of a loose pouch. The manufacturability of this garment is more difficult than some.

There is, therefore, a need for a simple garment that is easily manufactured for comfortably and securely affixing a medical monitor. There is a further need for a garment that is easy to put on and take off, even if the patient lacks mobility or is incapacitated.

BRIEF SUMMARY OF THE INVENTION

A purpose of this invention is to provide a method and apparatus for carrying a medical apparatus on the person of a patient. Additional purposes are to provide a garment that is simple to manufacture, and can be put on and taken off a patient, even if the patient lacks mobility or is incapacitated.

The garment comprises a cloth portion, rectangular or similarly shaped, fitted to the chest or back of the patient and providing backing for a pouch into which a medical appliance and its wires and/or tubes are inserted; also two shoulder straps extending from the top corners of the rectangular portion that have provision for attachment with hook and loop fasteners, straps, ties, buttons or the like at their far ends. The two shoulder straps attach to the lower corners of the rectangular portion for a garment made for children. An adult version of the garment additionally comprises a back strap, made with loop material along its length for connection using hook and loop material. This back strap attaches to the bottom corners of the rectangular portion using hook and loop fastener, and the two shoulder straps attach to the back strap, also using hook and loop fastener material. The two shoulder straps usually cross on the side of the patient opposite the rectangular portion. The rectangular portion is fitted with a grommet through it such that it makes an access between the pouch and the patient for wires, tubes, etc. The pouch is sized adequately so excess lead or tube length can be carried within the pouch, thereby avoiding tangling. The "rectangular" portion may also be circular, oval, or any other suitable shape.

The novel features which are believed to be characteristic of this invention, both as to its organization and method of operation together with further objectives and advantages thereto, will be better understood from the following description considered in connection with the accompanying drawings in which a presently preferred embodiment of the invention is illustrated by way of example. It is to be expressly understood however, that the drawings are for the purpose of illustration and description only and not intended as a definition of the limits of the invention.

BRIEF DESCRIPTION OF THE SEVERAL VIEWS OF THE DRAWINGS

FIG. 8 is a perspective view showing a rear-view of the adult patient with the garment on.

DETAILED DESCRIPTION OF THE INVENTION

Figure 1:
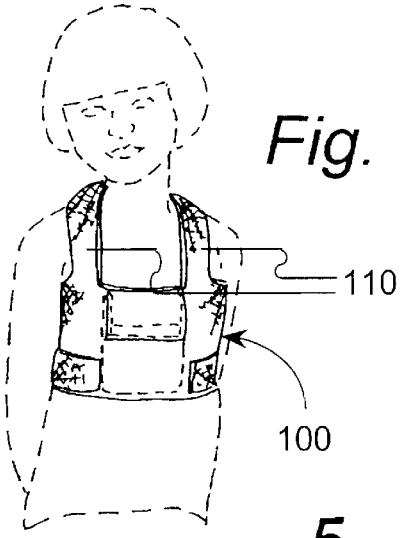
FIG. 1 is a perspective view showing the garment of the present invention on a child with the pouch placed on the front of the patient.

A child is shown from the front wearing a garment 100 for carrying a medical appliance in FIG. 1. In this instance, the medical appliance is worn on the patient's chest. The garment 100 may also be turned around so the appliance is worn on the patient's back, when desired. In either case, the two shoulder straps 110 are worn over the patient's shoulders. The bulk of the garment is made of cloth. The cloth may be of single or multiple thicknesses. A light cotton material would be suitable for summertime wear, while a flannel might be more suitable for wintertime warmth.

Figure 2:
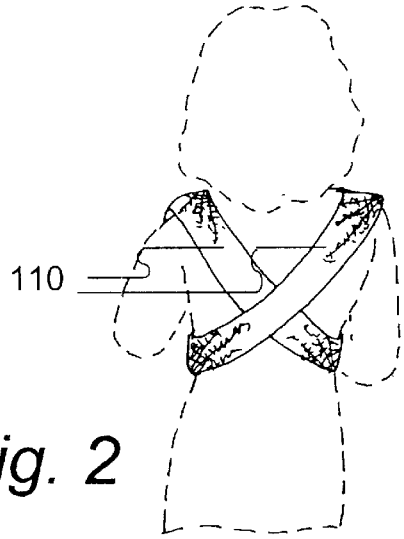
FIG. 2 is a perspective view showing a rear-view of a patient in the garment with the two shoulder straps crossed in the back of the patient, the pouch being placed on the front of the patient.

A rear-view of the patient and garment is shown in FIG. 2. Of the garment, only the two shoulder straps 110 are visible. In the preferred embodiment, the two shoulder straps 110 are crossed as shown, but this invention is not limited to crossing the two shoulder straps.

Figure 3:
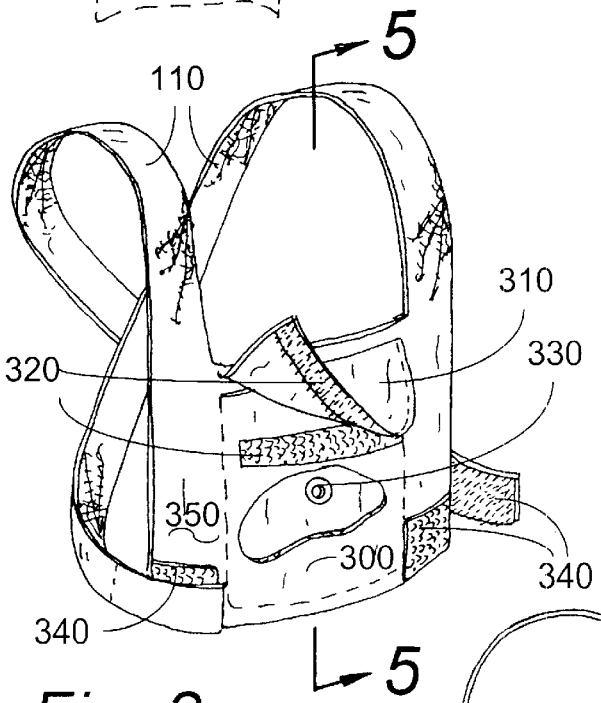
FIG. 3 is an enlarged perspective view showing the garment for children with a flap closure on the pouch and the two shoulder straps crossed, a cutaway portion showing the grommet inside the pouch, leading to the patient.

More details of the garment are shown in FIG. 3. A pouch 300 is provided for conveniently carrying a medical apparatus such as cardiac, gastric, or sleep apnea monitors, or medication injectors (not shown in FIG. 3). It has a flap closure 310 that can be secured by hook and loop fasteners 320 as shown, or buttons, snaps, or ties. The pouch 300 is affixed to the rectangular cloth portion 350 on three of its sides. (The rectangular shape is not necessary, and this invention is not limited thereto.) As can be seen through the cutout, a grommet 330, through which leads or tubes 400 are passed, is inserted in the garment 100 that makes up the back of the pouch 300. The two shoulder straps 110 are, again, shown crossed. The shoulder straps 110 are removably attached to the lower corners of the rectangular cloth piece 350 (to which the pouch 300 is attached) by hook and loop fasteners 340 as shown, or buttons, snaps, or ties.

Figure 4:
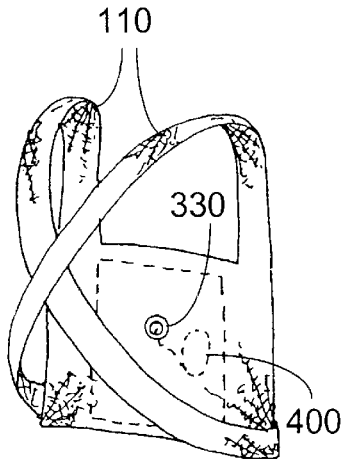
FIG. 4 is a perspective view showing the garment from the strap-side, with the grommet in view.

FIG. 4 is a view from the direction of the straps 110. The two shoulder straps 110 are, again, crossed. The grommet 330 is evident from this direction. A lead or tube 400 (dashed line) extends out of the grommet 330 from the medical appliance 500 inside the pouch 300.

Figure 5:
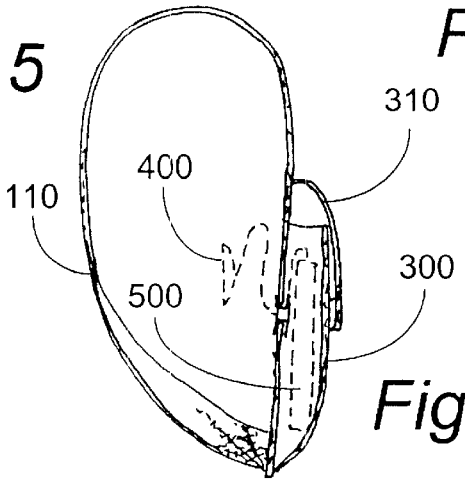
FIG. 5 is a side elevation view showing of the garment with a medical appliance in the pouch (in dashed lines) and a lead exiting the pouch through the grommet.

A side view of the garment 100 is shown in FIG. 5. A medical appliance 500 can be seen (drawn in dashed lines) inside the pouch 300. The lead or tube 400 (dashed line) is shown, again, extending out of the grommet 330 from the medical appliance 500 inside the pouch 300.

Figure 6:
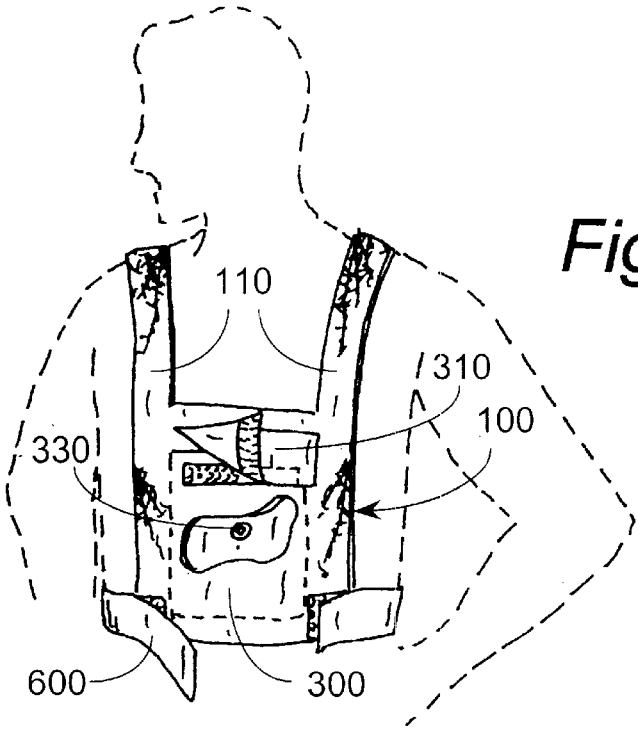
FIG. 6 is a perspective view showing an adult version of the garment with a back strap made with hook and loop material for attaching the two shoulder straps.
Figure 7:
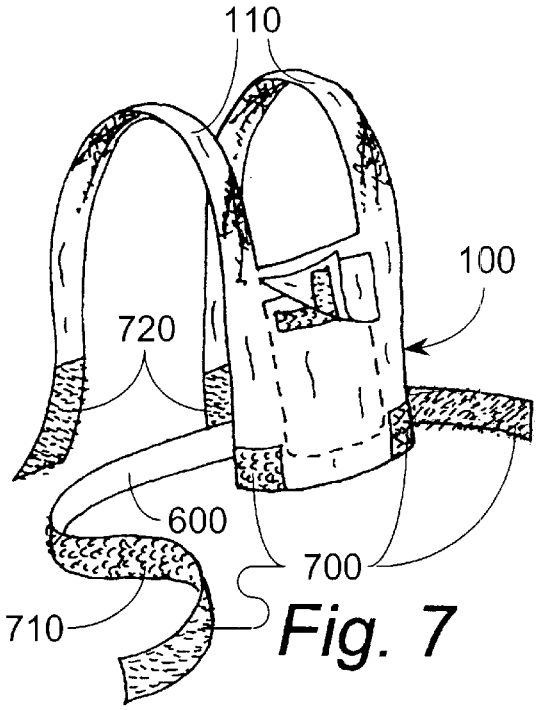
FIG. 7 is a perspective view of the adult version of the garment with the shoulder straps extending straight down.
Figure 8:
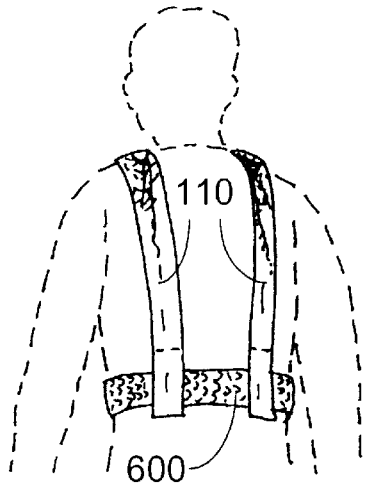

A second embodiment of the present invention is shown in FIGS. 6–8. This embodiment is for adult wearers of the garment 100. The basic garment 100 is the same as previously described. For the extra stability required by a patient with a longer torso, a back strap 600 is included which wraps around the torso of the wearer, and is removably attached (using hook and loop fasteners 700, buttons, snaps, ties or other attaching devices) to the lower corners of the essentially rectangular A second embodiment of the present invention is shown in FIGS. 6–8. This embodiment is for adult wearers of the garment 100. The basic garment 100 is the same as previously described. For the extra stability required by a patient with a longer torso, a back strap 600 is included which wraps around the torso of the wearer, and is removably attached (using hook and loop fasteners 700, buttons, snaps, ties or other attaching devices) to the lower corners of the essentially rectangular front cloth portion 340 on which the pouch 300 is attached. The back strap 600 is made of, or covered with loop material 710 for use with hook material in a hook and loop fastener system. Hook material 720 is applied to the ends of the shoulder straps 110 by which the shoulder straps 110 are removably attached to the back strap 600 in use. Cloth portion 340 on which the pouch 300 is attached. The back strap 600 is made of, or covered with loop material 710 for use with hook material in a hook and loop fastener system. Hook material 720 is applied to the ends of the shoulder straps 110 by which the shoulder straps 110 are removably attached to the back strap 600 in use.

The above describes the preferred embodiment, but this invention is not limited thereto. The garment may be made of a variety of materials. The two shoulder straps may or may not be crossed. As mentioned, the garment may be worn with the medical appliance on the front or back of the patient. It has, therefore, been shown that many modifications and variations of the present invention are possible in light of the above teachings. It is, therefore, to be understood that within the scope of the appended

We claim:

1. A garment for a patient to wear for carrying a medical appliance, the apparatus comprising:

(a) a front cloth portion shaped and sized to fit from the patient's upper mid-torso to the waist (b) a pouch attached on three sides to the face of said front cloth portion wherein, the front cloth portion is further provided with a grommet providing a passage into the pouch (c) two shoulder straps extending from an upper edge of said front cloth portion, over a patient's shoulders, and passing around a patient's side opposite that of the front cloth portion, each shoulder strap having a free end; and (d) fasteners disposed on each of the shoulder straps and the front cloth portion for removably attaching free ends of the two shoulder straps in a criss-cross fashion to secure the garment on the patient.

2. The apparatus of claim 1 wherein the front cloth portion is significantly rectangular in shape.

3. The apparatus of claim 1 wherein the pouch is a patch of material attached to the front cloth portion so a back of the pouch is formed by the front cloth portion.

4. The apparatus of claim 1 wherein the two shoulder straps are crossed.

5. The apparatus of claim 1 wherein the two shoulder straps are removably attached to the lower edge of the front cloth portion.

6. The apparatus of claim 1 additionally comprising a back strap extending from a first location near a lower edge of the front cloth portion, around the patient's lower torso to a second location near the lower edge of the front cloth portion.

7. The apparatus of claim 6 wherein the two shoulder straps removably attach to the back strap.

8. The apparatus of claim 1 wherein the pouch has a flap closure.

9. A method for wearing a garment to carry a medical appliance, said garment comprising a front cloth portion sized to fit from the patient's upper mid-torso to the waist having a pouch attached thereto on three sides of the pouch; wherein a grommet is placed in the front cloth portion to make a passageway into the pouch for passing leads from the medical appliance to the patient and with two shoulder straps extending from a top of the front cloth portion and each having a free end, the method comprising the steps of:

(a) placing the front cloth portion on a patient's torso so the two shoulder straps extend upward;

(b) passing the two shoulder straps over the shoulders of the patient;

(c) removably attaching ends of the two shoulder straps in a criss-cross fashion to secure the garment; and (d) carrying the medical appliance in the pouch.

10. The method of claim 9 wherein the two shoulder straps cross one another on a side of the patient opposite the front cloth portion.

11. The method of claim 9 wherein the step of removably attaching the ends of the two shoulder straps comprises removably attaching the ends of the two shoulder straps to a lower edge of the front cloth portion.

12. The method of claim 9 additionally comprising the steps of:

(a) passing a back strap around the lower torso of the patient;

(b) removably attaching two ends of the back strap to a lower edge of the front cloth portion;

(c) removably attaching the ends of the two shoulder straps to the back strap.

* * * * *